US006243060B1

(12) United States Patent
Natori

(10) Patent No.: US 6,243,060 B1
(45) Date of Patent: Jun. 5, 2001

(54) IMAGE DISPLAY AND ITS PIXEL ARRANGEMENT METHOD

(75) Inventor: Takehisa Natori, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/171,454

(22) PCT Filed: Feb. 19, 1998

(86) PCT No.: PCT/JP98/00687

§ 371 Date: Jan. 21, 1999

§ 102(e) Date: Jan. 21, 1999

(87) PCT Pub. No.: WO98/37534

PCT Pub. Date: Aug. 27, 1998

(30) Foreign Application Priority Data

Feb. 20, 1997 (JP) ..... 9-036047

(51) Int. Cl.[7] ..... G09G 3/36

(52) U.S. Cl. ..... 345/88; 345/152; 345/150

(58) Field of Search ..... 345/83, 87, 88, 345/150, 151, 152, 154, 153, 155, 967, 970, 971, 1

(56) References Cited

U.S. PATENT DOCUMENTS 5,057,739 10/1991 Shimada et al. .
5,767,837 * 6/1998 Hara ..... 345/152

FOREIGN PATENT DOCUMENTS 612536 11/1990 (AU) .
0376332 A2 7/1990 (EP) .
0397965 A2 11/1990 (EP) .
2-178692 7/1990 (JP) .
2-304843 12/1990 (JP) .
3-269567 12/1991 (JP) .
7-129097 5/1995 (JP) .

OTHER PUBLICATIONS

IBM Technical Disclosure Bulletin (vol. 33 No. 6B), Nov. 1990.*

* cited by examiner

*Primary Examiner*—Bipin Shalwala
*Assistant Examiner*—Mansour M. Said
(74) *Attorney, Agent, or Firm*—Frommer Lawrence & Haug, LLP.; William S. Frommer

(57) ABSTRACT

The present invention relates to a jumbo-size screen image display apparatus set up in a ground or the like and a pixel arrangement method thereof. According to the present invention, a plurality of color elements are arranged in an in-line arrangement fashion to form one pixel, this pixel is disposed on a plurality of horizontal lines and a plurality of vertical lines, and a color element or a color element group having the highest luminosity factor in each pixel is alternately arranged at the right-hand or left-hand end position at every horizontal line.

Thus, there may be removed the disadvantage that the color is changed by the pixel hidden by a louver, and hence the apparent horizontal resolution and the apparent vertical resolution may be improved.

28 Claims, 11 Drawing Sheets

IMAGE DISPLAY AND ITS PIXEL ARRANGEMENT METHOD

TECHNICAL FIELD

The present invention relates to a jumbo-size screen image display apparatus having relatively few pixels set up in a ground or the like and a pixel arrangement method thereof.

BACKGROUND ART

Jumbo-size screen image display apparatus that are set up in a ground such as a baseball field, a soccer ground and so on or a wall of a building and so on generally have relatively few pixels in which 320 pixels are arranged in the horizontal direction and 240 pixels are arranged in the vertical direction, for example. In such known jumbo-size screen image display apparatus, one pixel is comprised of a set of small/non-deflection CRTs (cathode-ray tubes) each including red (R), green (G), blue (B) fluorescent screens, one pixel is comprised of a set of LEDs (light-emitting diodes) each for emitting lights of red, green and blue or the like.

FIGS. 10 and 11 show the manner in which pixels are arranged in the conventional jumbo-size screen image display apparatus.

In FIGS. 10 and 11, one pixel is formed by arranging color elements 1 [1R, 1G, 1B] of elliptic red, green, blue LEDs at vertexes of a triangle. The manner in which the color elements 1R, 1G, 1B are arranged at vertexes of the triangle in this manner is referred to as a delta color element arrangement. To be more in detail, the manner in which color elements are arranged in FIG. 10 is called a lateral-delta color element arrangement and the manner in which color elements are arranged in FIG. 11 is called an inverse-delta color element arrangement. Further, in any of FIGS. 10 and 11, respective pixels are simply arranged in the longitudinal and horizontal directions. The manner in which pixels are simply arranged in the longitudinal and horizontal directions as described above is called a square arrangement.

There is also an increasing demand that the jumbo-size screen image display apparatus for use in a ground, an advertisement on the wall of building or the like exhibits a higher image quality. In particular, a high contrast at which a picture may become clear under high illuminance, a high resolution which enables an object image to be displayed as detailedly as possible or a small pixel pitch which may cope with a relatively small image is of great importance.

Then, since it is difficult to form a large screen integrally, it is customary that a large screen is formed by a combination of a plurality of small screens. In that case, however, it is unavoidable that an ineffective portion such as an attachment space, a thick portion of case and so on occurs in a joint of small screens. To solve this problem, elements of three colors are grouped, and a pixel pitch is provided by adding the ineffective portion to an effective portion. At that time, considering a uniformity of a screen, it is necessary that a pixel pitch within small screens and a pixel pitch between small screens become equal to each other. Also, since a finally-assembled screen is of oblong rectangle, small screens also are made rectangular. Therefore, when it is intended to obtain a small pixel pitch by using small elements for every color like the LED, generally, elements of three colors are arranged in a delta-fashion by grouping the ineffective portions and the pixels thereof are arranged in a square-arrangement fashion. In FIGS. 10 and 11, for example, one small screen (so-called unit cell) Pi, j, Pi+1, j or the like comprises 16 pixels formed of 4 pixels in the horizontal direction and 4 pixels in the vertical direction. Then, FIG. 10 shows that a pixel pitch is L1, and FIG. 11 shows that a pixel pitch is L2.

Further, in order to avoid lowering of a contrast by an external light, in FIGS. 10 and 11, each pixel includes eaves (louver) 2 provided on its upper portion as shown in FIG. 12. The louver 2 should preferably be sized so as not to narrow upper and lower visual field angles θ3, θ2. Therefore, the LED on the lower side of the delta layout, i.e. color element 1 (red color element IR in FIG. 10 or blue color element 1B in FIG. 11) is unable to completely interrupt external light. Thus, if there is an incident light of low angle, then such incident light is not interrupted by the louver 2, reached and then reflected on the screen, thereby resulting in a contrast being lowered. Moreover, if an angle looking at screen upward exceeds a design visual field angle (angle at which the louver 2 may not hide the LED element 1) θ4, then the LED color element 1 on the lower side of the delta layout is hidden by the upper louver 2 of the pixel beneath it. There is then the drawback that a color is changed. In this connection, by way of example, an external light incident angle θ1 is about 25°, the lower visual field angle θ2 is about 28°, the upper visual field angle θ3 is about 1° and the design visual field angle θ4 is about 29°.

On the other hand, as shown in FIG. 9, there may be considered a jumbo-size screen image apparatus in which one pixel is formed by aligning in a line a red element 1R, a green element 1G and a blue element 1B, each of which is formed of an elliptic LED. To align the color elements 1 [1R, 1G, 1B] in a line in this way is called an in-line color element arrangement. Also in this case, since pixels are simply arranged in the longitudinal and horizontal directions, this arrangement is called a square arrangement. Although the color elements are not hidden by the louvers so that a color is not changed in the jumbo-screen image apparatus in which the pixels are arranged as described above, it is difficult to reduce a pixel pitch L3. Moreover, since the number of pixels per unit area is decreased, a brightness is lowered so that an image of high-definition may not be obtained. Also, when the color element is comprised of a CRT (cathode-ray tube), a degree at which a contrast is lowered by an external light at low incident angle is greater than a degree at which a contrast is lowered in the delta-arrangement.

Furthermore, there is known such an image display apparatus that an apparent horizontal resolution and an apparent vertical resolution are increased by an oblique arrangement in which a pixel is shifted at every row by a half pitch. However, when a large screen is formed of a combination of a plurality of small screens, it is difficult to maintain an ineffective portion. Therefore, the application of such known image display apparatus is limited to an integral-type liquid-crystal display apparatus.

DISCLOSURE OF INVENTION

In view of the aforesaid aspect, the present invention is to provide an image display apparatus and a pixel arrangement method thereof having features in which a contrast may be prevented from being lowered under an external light at a low incident angle, a color may be prevented from being changed even when a visual field angle exceeds a designed visual field angle, an apparent horizontal resolution and an apparent vertical resolution may be improved and so on.

An image display apparatus according to the present invention is an image display apparatus having a pixel arrangement in which a plurality of color elements are arranged horizontally to form one pixel and this pixel is disposed on a plurality of horizontal lines and a plurality of vertical lines and a color element or a color element group having the highest luminosity factor in each pixel is alternately disposed at the right-hand or left-hand end position at every horizontal line.

A pitch in which the color element or the color element group having the highest luminosity factor is arranged in the horizontal direction of one row and a pitch in which the above color element or the color element group is arranged in the vertical direction are made equal to each other.

When a plurality of cells formed of a plurality of pixels are arranged to form one unit, pitches in which the color element or the color element group having the highest luminosity factor is arranged in the horizontal and vertical directions of one row are made equal to each other within the cell and between the respective cells.

Also, when a plurality of cells formed of a plurality of pixels are arranged to form one unit and a plurality of units are arranged to form a display screen, pitches in which the color element or the color element group having the highest luminosity factor is arranged in the horizontal and vertical directions of one row are made equal to each other within the cell and between the respective cells.

According to the above-mentioned arrangement, owing to the so-called in-line color element arrangement in which a plurality of color elements comprising one pixel are arranged on the in-line, it is possible to avoid the disadvantage that the color is changed by the pixel hidden by the louver. Further, since the color element or the color element group having the highest luminosity factor is arranged in the oblique direction, there may be improved the apparent horizontal resolution and the apparent vertical resolution. Accordingly, the number of pixels per unit area increases so that an image of high luminance and high definition may be obtained.

Further, when a plurality of cells each formed of a plurality of pixels are combined to form one unit and a plurality of units are combined to form a large screen, each pixel is arranged at an equal pitch in the vertical and horizontal directions, thereby making it possible to display an image as one continuous image in which an image joint portion is not formed.

Further, the image display apparatus according to the present invention is an image display apparatus having a pixel arrangement in which a red color element, a green color element and a blue color elements are arranged horizontally to form one pixel and this pixel is disposed on a plurality of horizontal lines and a plurality of vertical lines. The green color element in each pixel is alternately disposed at the right-hand or left-hand end position at every horizontal line.

Each pixel pitch in the horizontal direction is selected to be approximately ¼, i.e. ¼ or a value approximated to ¼ of the pixel pitch in the horizontal direction of one row.

A pitch in which the green color element is arranged in the vertical direction and a pitch in which the green color element is arranged in the horizontal direction of one row are made equal to each other.

When a plurality of cells, each formed of a plurality of pixels, are arranged to form one unit, a pitch in which the green color element is arranged in the vertical direction and a pitch in which the green color element is arranged in the horizontal direction of one row are made equal to each other within the cell and between the respective cells equal to each other.

When a plurality of cells, each formed of a plurality of pixels, are arranged to form one unit and a plurality of units are arranged to form a display screen, a pitch in which the green color element is arranged in the vertical direction and a pitch in which the green color element is arranged in the horizontal direction of one row are made equal to each other within the unit and between the respective units.

According to the above-mentioned arrangement, owing to the so-called in-line color element arrangement in which red, green and blue color elements comprising one pixel are arranged in an in-line fashion, it is possible to avoid the disadvantage that the color is changed by the pixel hidden by the louver. Further, since the green color element having the highest luminosity factor is arranged in the oblique direction, there may be improved the apparent horizontal resolution and the apparent vertical resolution. Accordingly, there may be obtained an image of high luminance and high definition.

Also, when a plurality of cells, each formed of a plurality of cells, are combined to form one unit similarly as described above and further when a plurality of these units are combined to form a large screen, each pixel is arranged at an equal pitch in the vertical and horizontal directions, thereby making it possible to display an image as one continuous image in which an image joint portion is not formed.

According to the present invention, each pixel row should preferably include a louver formed thereon to interrupt an external light. The louver may be provided at every other pixel row or at every plurality of rows.

When the louver is provided at every row, even under an external light at a low incident angle, a contrast of an image may be prevented from being lowered.

Also, when the louver is provided at every other row or at every plurality of rows, a contrast of an image may be prevented from being lowered under the external light.

Each color element may be formed of a light-emitting diode (LED) element, a cathode-ray tube (CRT), a discharge tube, an organic electroluminescence element or a liquid-crystal element or the like.

A pixel arrangement method for an image display apparatus according to the present invention comprises the steps of arranging a plurality of color elements horizontally to form one pixel, arranging this pixel on a plurality of horizontal lines and a plurality of vertical lines and, alternately arranging a color element or a color element group having the highest luminosity factor in each pixel at the right-hand or left-hand end position at every horizontal line.

Also, each pixel is arranged in such a manner that pitches in which the color element or the color element group having the highest luminosity factor are arranged in the horizontal direction of one row and in the vertical direction become equal to each other.

As described above, since the pixel arrangement method in which a plurality of color elements comprising one pixel are arranged in an in-line fashion and the color element or the color element group having the highest luminosity factor is arranged in the oblique direction is used, in the image display apparatus, it is possible to avoid the disadvantage that the color is changed by the pixel hidden by the louver. Thus, it becomes possible to improve the apparent horizontal and vertical resolutions.

Further, the pixel arrangement method for the image display apparatus according to the present invention comprises the steps of arranging a red color element, a green color element and a blue color element horizontally to form one pixel, arranging alternately this pixel on a plurality of horizontal lines and a plurality of vertical lines, and arranging a green color element in each pixel at the right-hand or left-hand end position at every horizontal line.

Each element within a pixel in the horizontal direction is arranged in such a manner that a pitch thereof becomes approximately ¼ of the pixel pitch of one row.

Further, each pixel is arranged in such a manner that a pitch in which a green color element is arranged in the vertical direction and a pitch in which a green color element is arranged in the horizontal direction of one row become equal to each other.

As described above, since the pixel arrangement method in which red, green and blue color elements comprising one pixel are arranged in an in-line fashion and the green color element having the highest luminosity factor is arranged in the oblique direction is used, in the image display apparatus in which the red, green and blue color elements comprise one pixel, it is possible to avoid the disadvantage that the color is changed by the pixel hidden by the louver. Thus, it becomes possible to improve the apparent horizontal and vertical resolutions.

According to the present invention, it is possible to realize a jumbo-size screen image display apparatus for use in a ground and an advertisement on the wall of a building or the like and in which a high contrast and a high resolution may be obtained and in which it is possible to avoid the disadvantage that a color is changed by the pixel hidden by the louver.

BEST MODE FOR CARRYING OUT THE INVENTION

A jumbo-size screen image display apparatus to which the present invention is applicable will hereinafter be described in detail with reference to the drawings.

Figure 1:
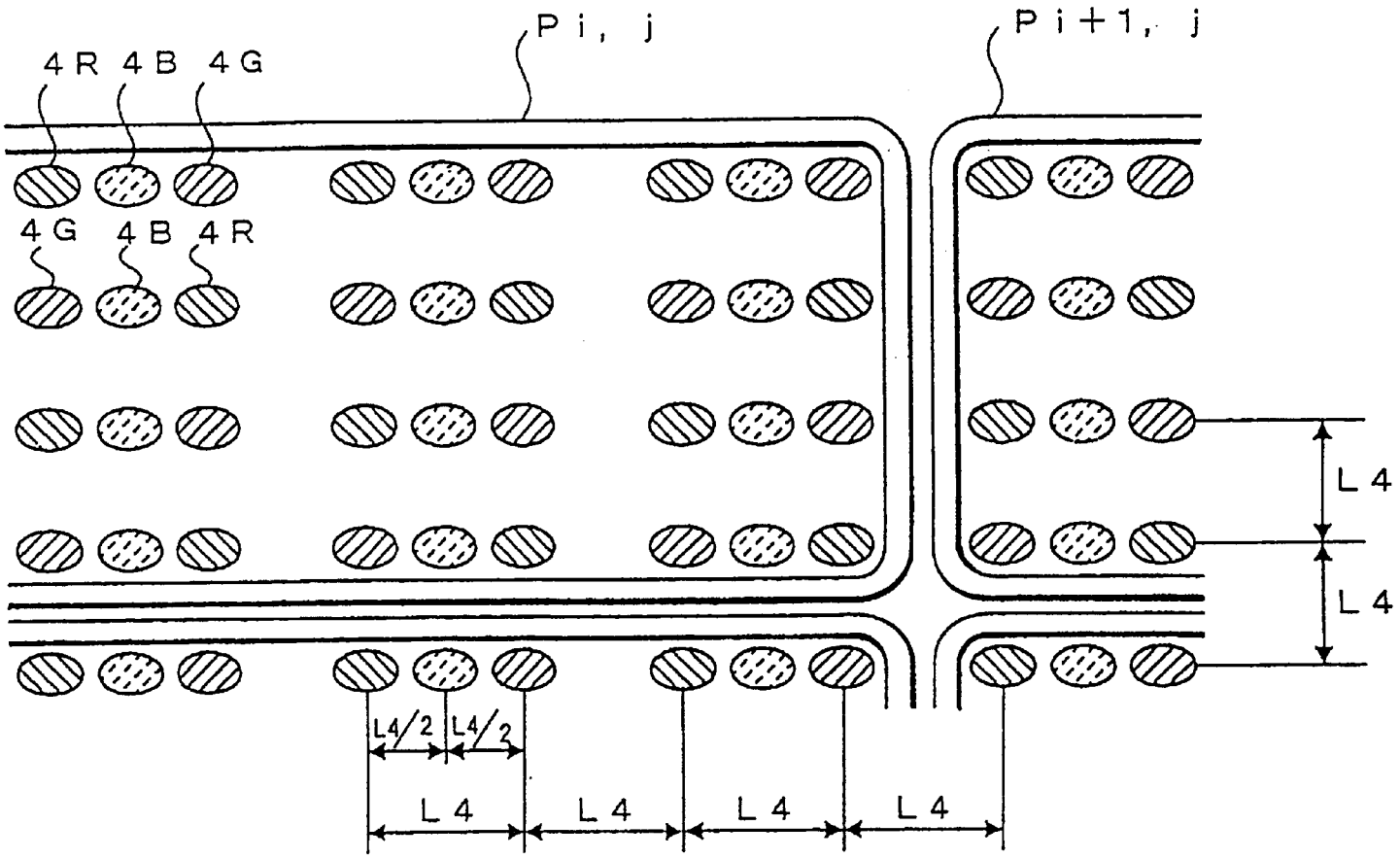
FIG. 1 is a structural diagram of a main portion showing an embodiment of a jumbo-size screen image display apparatus to which the present invention is applied.

FIG. 1 is a diagram showing the manner in which pixels are arranged in a jumbo-size screen image display apparatus to which the present invention is applied.

In a jumbo-size screen image display apparatus according to this embodiment, as shown in FIG. 1, on the topmost horizontal line of a small screen Pij, a blue color element 4B is located at the center and green and red color elements 4G, 4R are located adjacent to the blue color element on the horizontal line to thereby form one pixel. Then, a pixel having the same color element arrangement is repeatedly disposed on the same horizontal line at an equal pitch. With respect to the interval of pixels on one horizontal line, a distance between the centers of the green color element 4G and the red color element 4R within the pixel and a distance between the centers of the green color element 4G and the red color element 4R of the adjacent pixel are made equal to each other. In FIG. 1, the distances between the centers are both L4.

On the second horizontal line from the top in the small screen Pij, a pixel in which the green color element 4G and the red color element 4R are replaced with each other with respect to the color element arrangement of the topmost horizontal line is repeatedly disposed at an equal pitch. An interval between the pixels is made similar to that of the topmost horizontal line. Also, an interval between the horizontal lines also is made equal to the center distance L4 between the green color element 4R and the red color element 4R within the pixel. Further, the centers of the pixels on the upper and lower directions are arranged along the vertical line. The above-mentioned arrangement is repeated to form a small screen (so-called unit cell). In FIG. 1, four horizontal lines comprise one small screen. For example, 16 pixels comprising 4 pixels in the horizontal direction and 4 pixels in the vertical direction form one small screen.

An interval between small screens (Pij and Pi+1j in FIG. 1) that are adjacent to each other in the horizontal direction, i.e. an interval between the center of the green color element 4G or the red color element 4R at the right end of the small screen Pij and the center of the red color element 4R or the green color element 4G at the left end of the small screen Pi+1j also is made equal to the distance L4 between the centers of the green color element 4G and the red color element 4R within the pixel. This relationship applies for other small screens which are adjacent to each other in the vertical direction as well.

Then, a plurality of small screens are arranged in the horizontal direction and the vertical direction. 256 small screens composed of 16 small screens in the horizontal direction and 16 small screens in the vertical direction, for example, comprise one middle screen, i.e. so-called one unit (not shown), and a plurality of units are arranged in the horizontal and vertical directions to thereby form a jumbo-size screen image display apparatus.

In the adjacent units in the horizontal direction, an interval between the center of the green color element 4G or the red color element 4R at the right end of one unit and the center of the red color element 4R or the green color element 4G at the left end of other adjacent unit is made equal to the distance L4 between the centers of the green color element 4G and the red color element 4R within the pixel. With respect to the adjacent units in the vertical direction, an interval between the pixels is made equal to the interval L4 between the centers of the green color element 4G and the red color element 4R within the pixel.

The respective color elements 4 [4R, 4G, 4B] may be composed of red, green and blue color LEDs (light-emitting diodes) each of which is shaped as an ellipse having a long axis in the horizontal direction.

Figure 6:
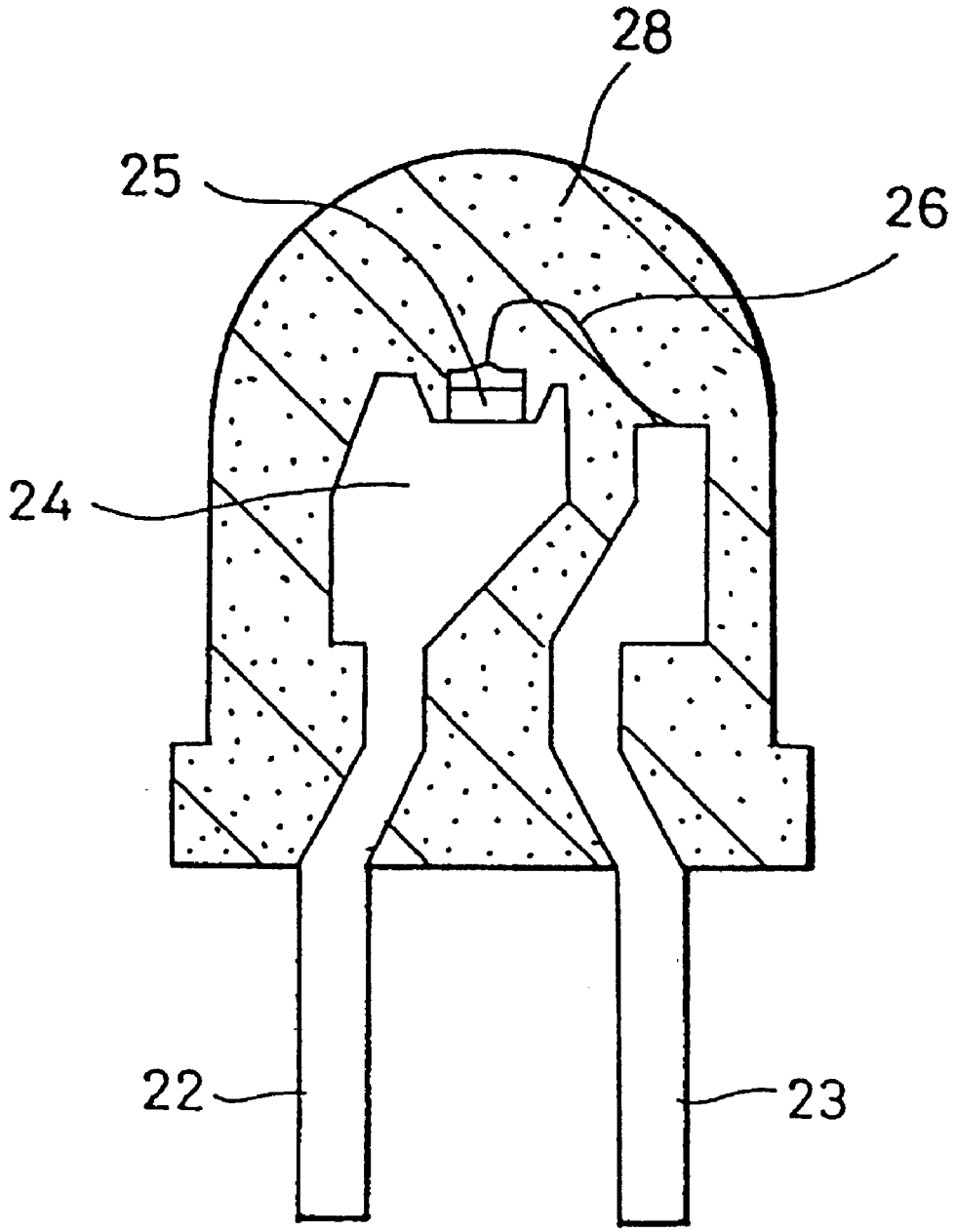
FIG. 6 is a cross-sectional view showing an example of a light-emitting diode element which is applicable to a color element of an image display apparatus according to the present invention.

FIG. 6 shows an example of LED.

An LED 21 is formed such that an LED element 25 is attached to a horn portion 24 made integral with one terminal 22 of a lead frame by die bond, an electrode of the LED element 25 is attached to the other terminal 23 by a metal wire 26 according to wire bon and then the whole of the arrangement is molded by a resin 27 in which a pigment of color is dispersed. A lens surface 28 is formed on the front surface of the mold resin 27.

In the jumbo-size screen image apparatus of FIG. 1, a pixel pitch in the horizontal direction of one row becomes 2L4, and a distance between the centers of the color elements 1 which are adjacent to each other within one pixel, i.e. color element pitch becomes ¼ of pixel pitch 2L4 (=L4/2).

Examining the green color element 4G having the highest luminosity factor receives a remarkable attention, the arrangement pitch of the green color element 4R in the horizontal direction of one row and the arrangement pitch of the green color element 4R in the vertical direction both become the equal pitch 2L4. Then, since the position of the green color element 4G having the highest luminosity factor becomes the position of the apparent pixel, the apparent pixel pitches in the horizontal direction and the vertical direction in FIG. 1 become the same pitch L4.

The pixel pitch, the color element pitch and the arrangement pitches of the green color element in the horizontal and vertical directions are made the same within the cells, between the cells, within the units and between the units.

Figure 3:
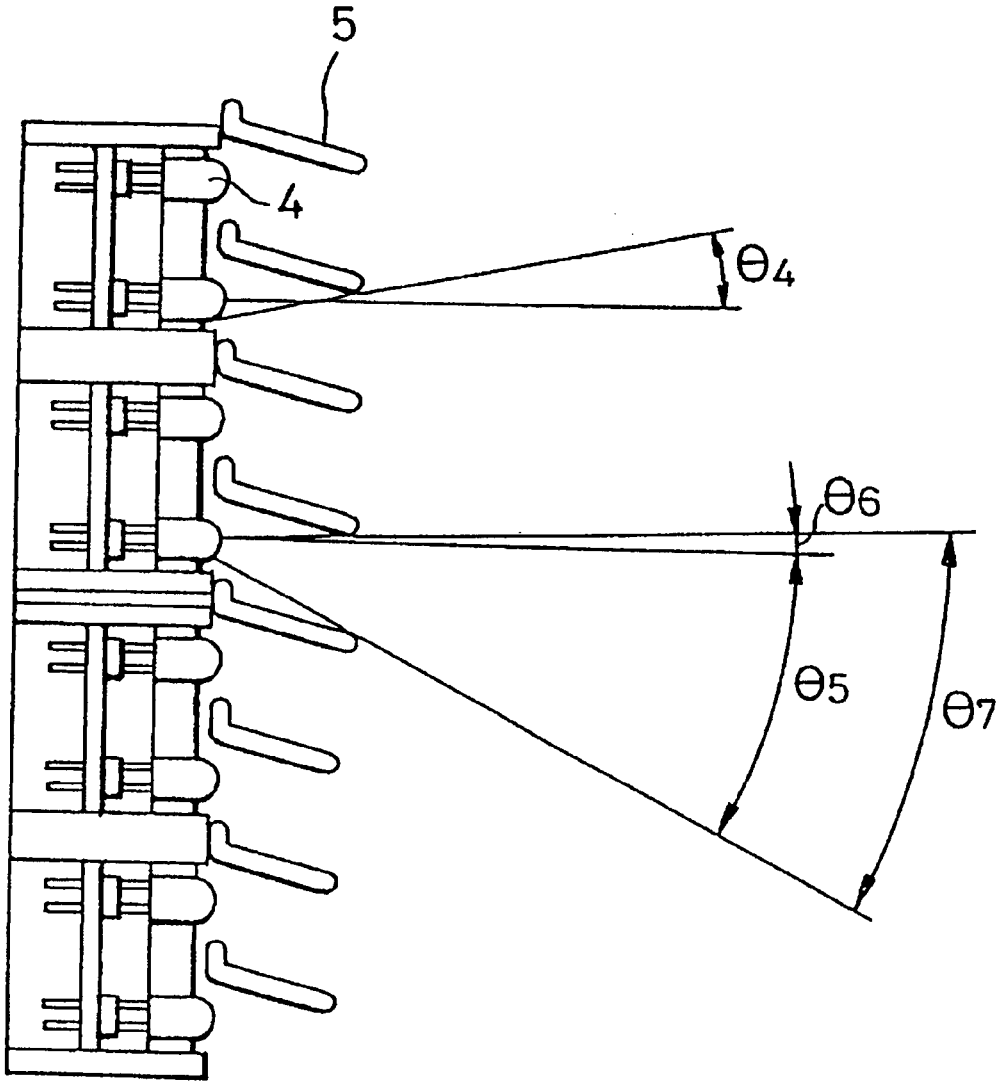
FIG. 3 is a cross-sectional view of a main portion of the embodiment showing the manner in which louvers are attached in a jumbo-size screen image display apparatus to which the present invention is applied.

This jumbo-size screen image display apparatus includes, as shown in FIG. 3, louvers 5 formed on the upper portion of every row of each horizontal pixel within each small screen to satisfactorily maintain upper and lower visual field angles and which may interrupt an external light at a low incident angle. The louvers 5 are jointed at the ineffective portion between the pixels within the small screen in the horizontal direction, thereby resulting in the integral louver being formed in the horizontal direction within the small screen.

With respect to the louver 5, for example, an external light incident angle θ4 is about 11°, a lower visual field angle θ5 is about 28°, an upper visual field angle θ6 is about 1°, and a design visual field angle θ7 (=θ5+θ6) is about 29.5°.

Figure 9:
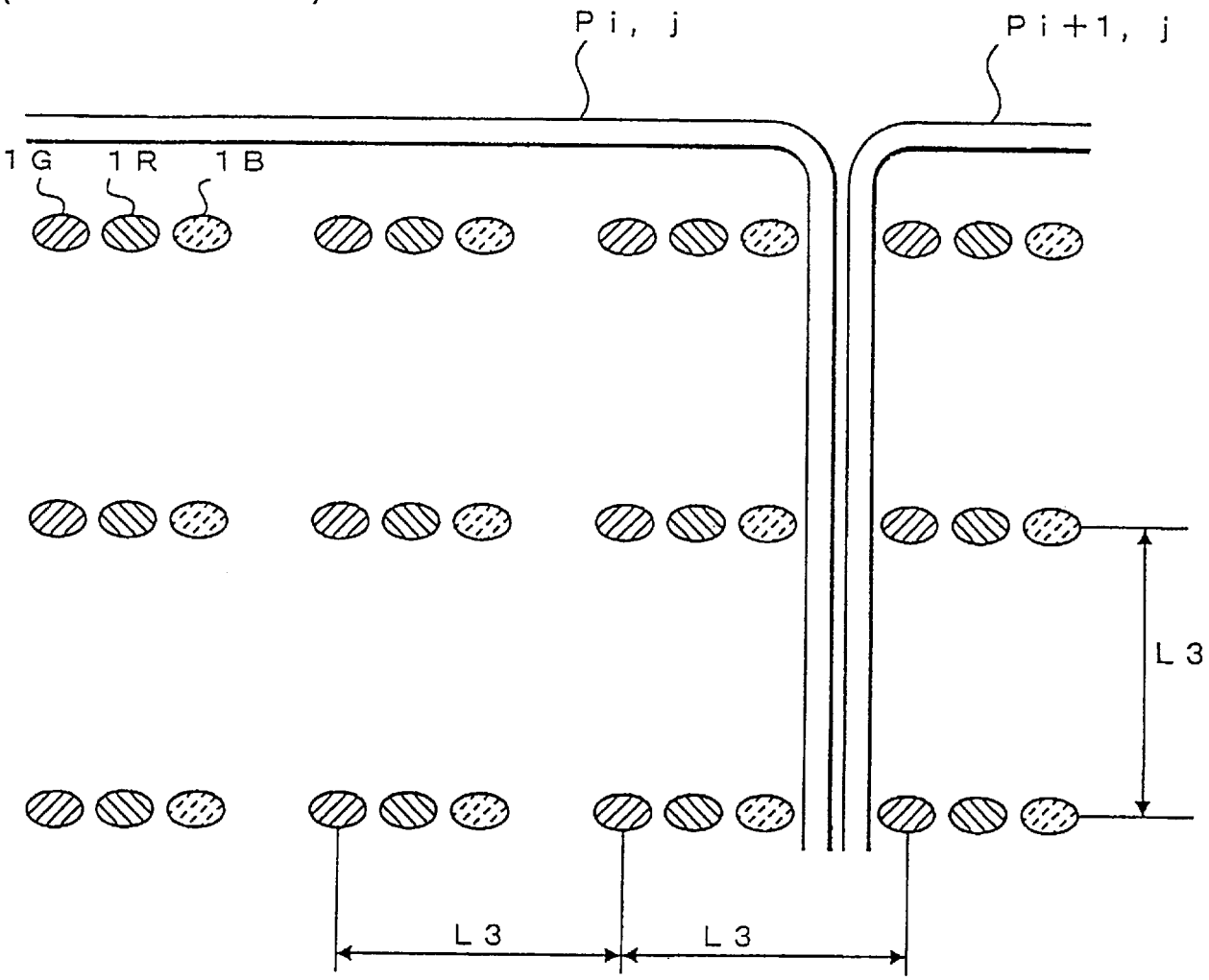
FIG. 9 (RELATED ART)
FIG. 9 is a structural diagram showing an in-line color element arrangement in a comparative jumbo-size screen image display apparatus.
Figure 10:
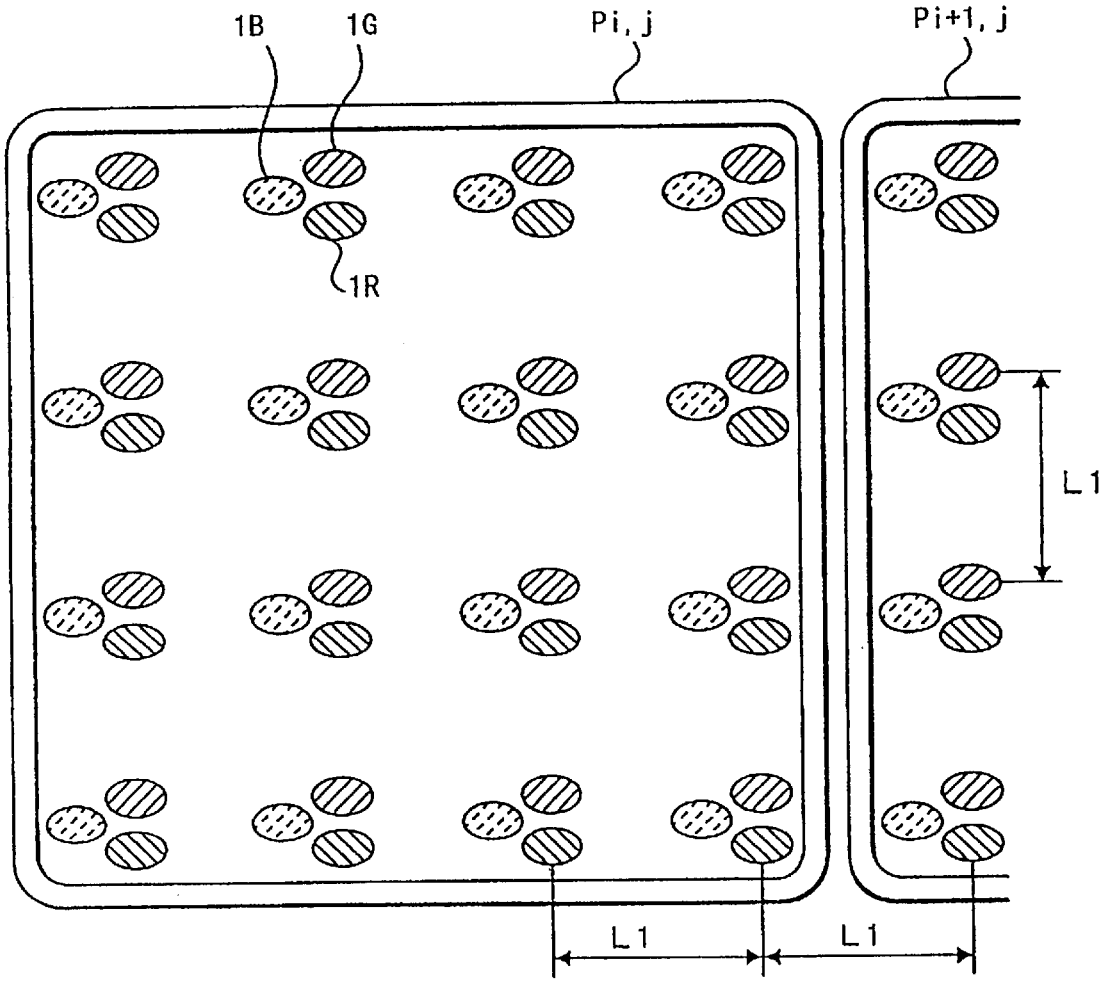
FIG. 10 (PRIOR ART)
FIG. 10 is a structural diagram showing a lateral-delta color element arrangement in a conventional jumbo-size screen image display apparatus.
Figure 11:
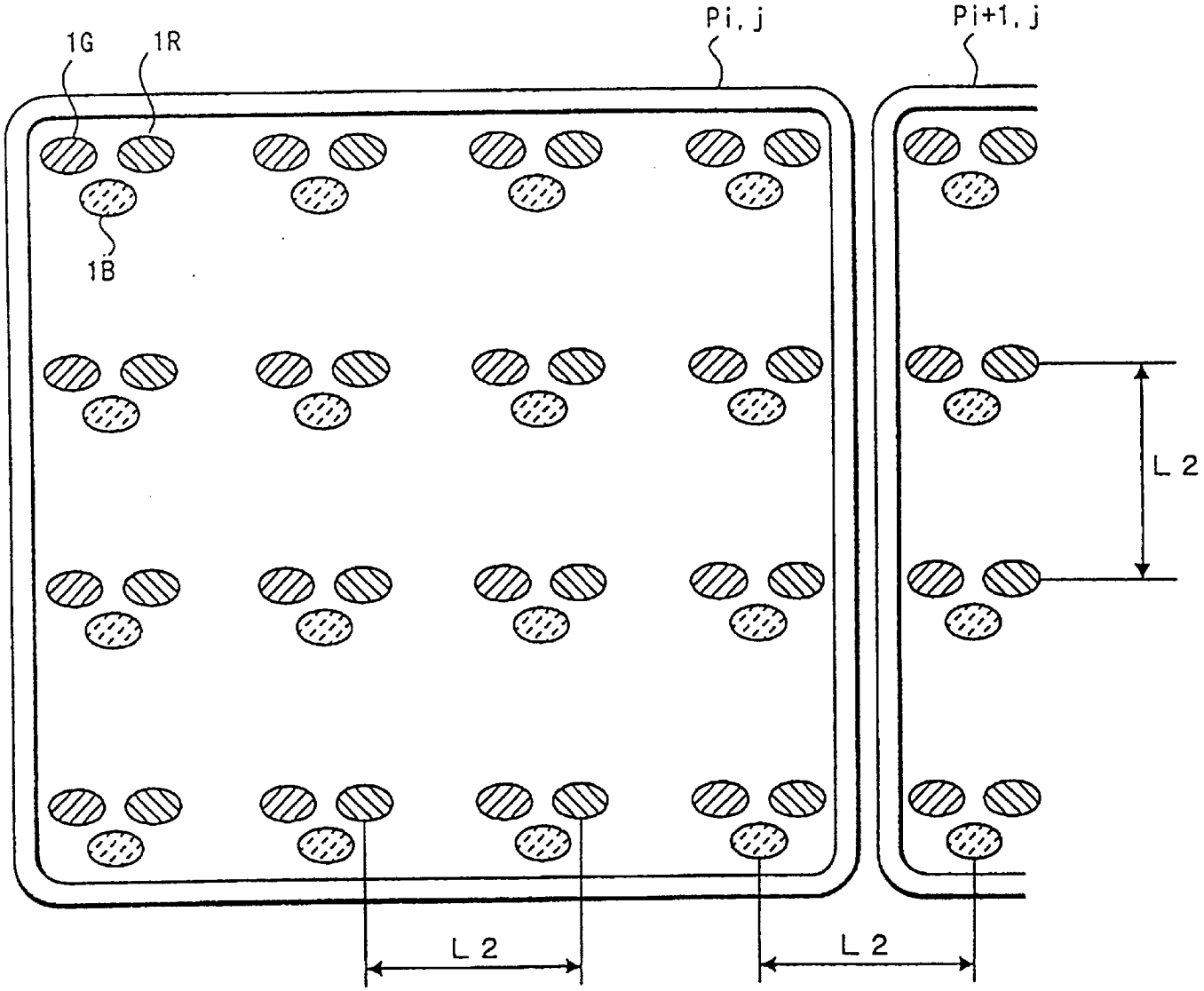
FIG. 11 (PRIOR ART)
FIG. 11 is a structural diagram showing an inverse-delta color element arrangement of a conventional jumbo-size screen image display apparatus.
Figure 12:
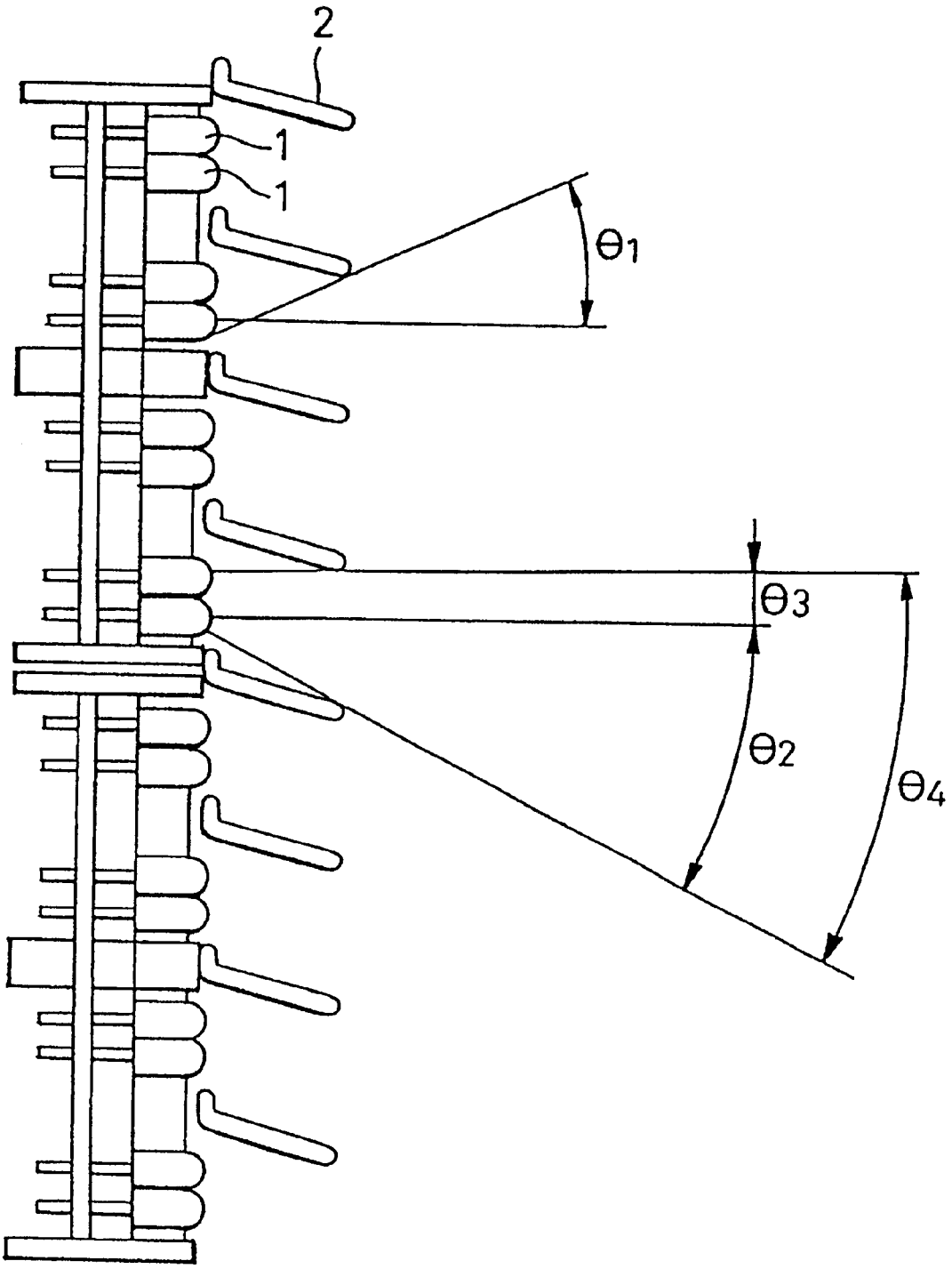
FIG. 12 (PRIOR ART)
FIG. 12 is a cross-sectional view of a main portion showing the manner in which louvers are attached in a conventional jumbo-size screen image display apparatus.

In the pixel arrangement shown in FIG. 1, since the green color element 4G having the highest luminosity factor is disposed in the oblique arrangement (checker-flag arrangement), there may be improved apparent horizontal resolution and apparent vertical resolution. That is, comparing FIGS. 9 and 1, if the size of the respective color elements is the same, then L4 becomes ½ of L3. Also, since the louver 5 is formed at every row, a contrast is not lowered even under the external light at a low incident angle. Further, since the red color element 4R, the green color element 4G and the blue color element 4B are arranged in an in-line color element arrangement fashion, it is possible to avoid the disadvantage that the color is changed by the pixel hidden by the louver.

Also, since the blue color element 4B having the lowest luminosity factor within the pixel is arranged at the center, a resolution of red information may be increased, thereby making it possible to improve a resolution on the whole.

While the louver 5 is provided at every row of the pixel as shown in FIG. 3, the present invention is not limited thereto and the louver 5 may be provided at every other row of pixel or at every row of a plurality of pixels.

The present invention is not limited to the arrangement shown in FIG. 1, and various modifications are made possible. As shown in other embodiment of FIG. 2, for example, the red color element 4R may be provided as the color element which becomes the center of the pixel. A rest of the arrangement is the same as that of FIG. 1. By placing the red color element 4R near the green color element 4G having the high luminosity factor at the center of the pixel as described above, it is possible to improve a mixture of colors.

Figure 2:
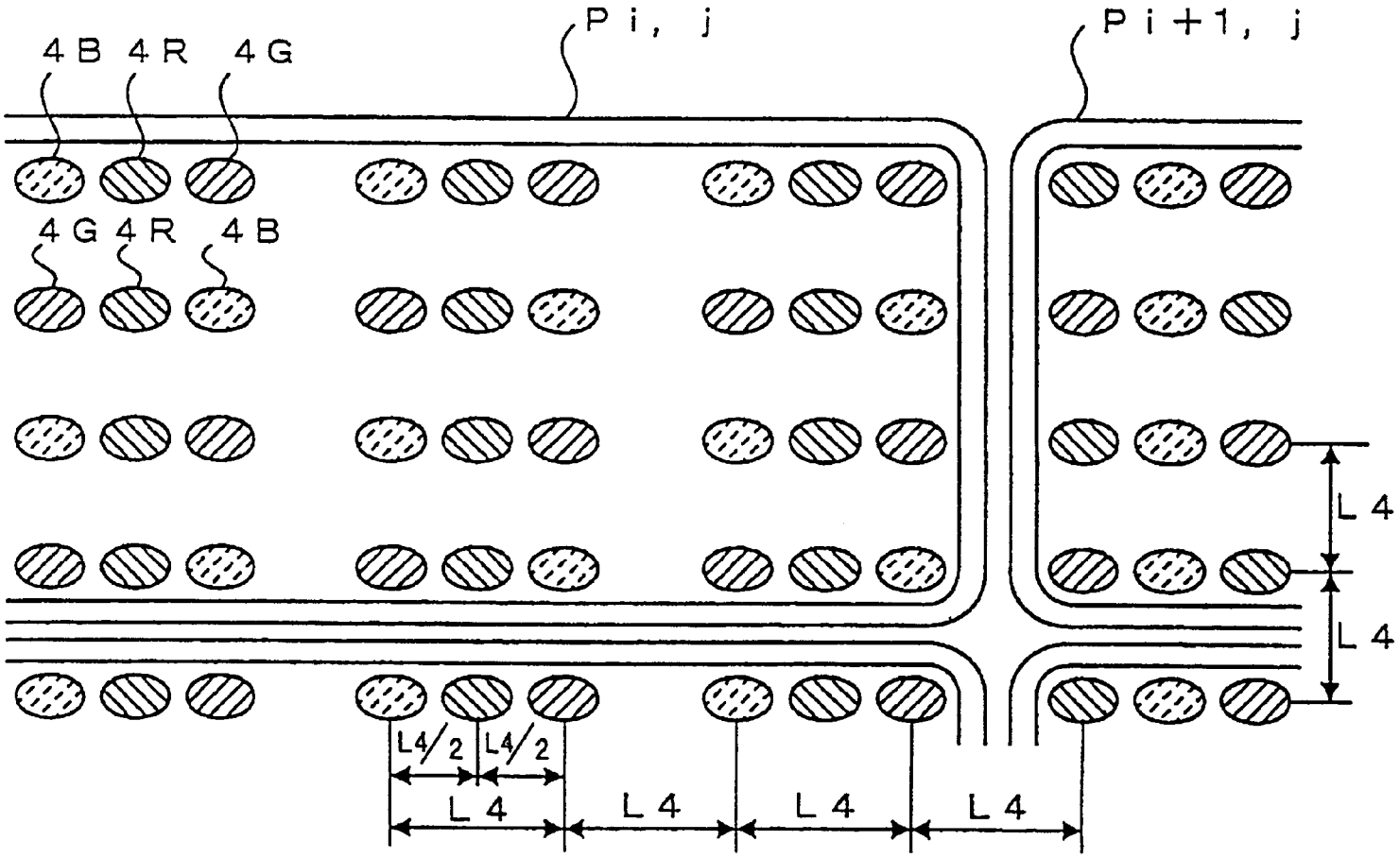
FIG. 2 is a structural diagram of a main portion showing another embodiment of a jumbo-size screen image display apparatus to which the present invention is applied.

While the three color elements are disposed at the equal interval (L4/2) within each pixel in FIGS. 1 and 2, this interval may not be limited to the equal interval. However, the interval between the color elements of the same color disposed at every pixel should be made equal over the whole screen of the jumbo-size screen display apparatus. Further, while the interval between the color elements (red color element and green color element in FIG. 1) which are most close to each other in the adjacent pixels in the horizontal direction is made as L4 in FIGS. 1 and 2, this interval may be made longer than L4 so long as it is held at the equal value throughout the whole screen of the jumbo-size screen display apparatus. Also, the louver which is provided at the upper portion of the pixel at every pixel may not be integrally formed with the upper portion along the horizontal direction.

Figure 4:
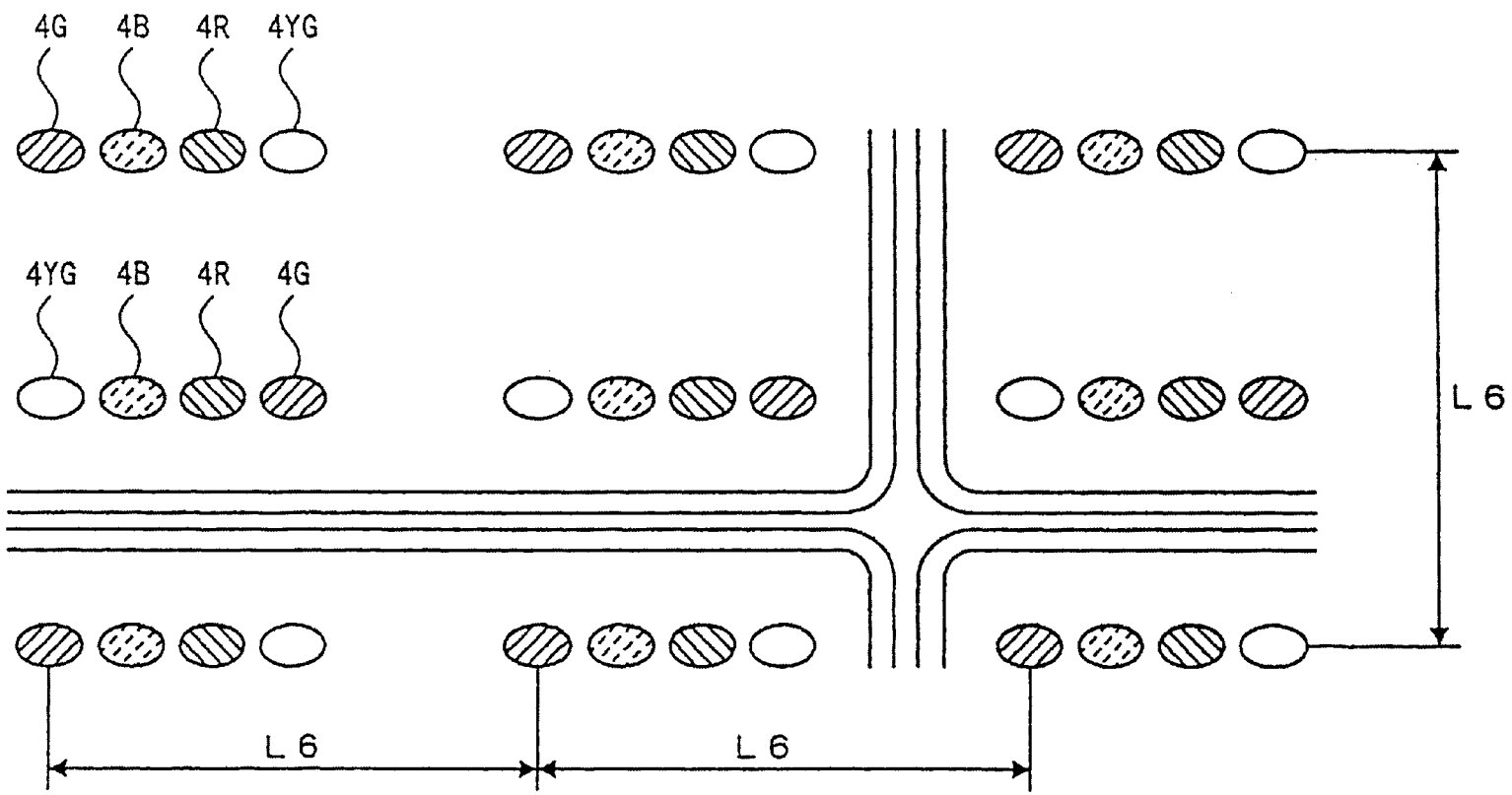
FIG. 4 is a structural diagram of a main portion of other embodiment showing a jumbo-size screen image display apparatus to which the present invention is applied.

While the three elements 4R, 4G, 4B of red, green and blue constitute one pixel in FIGS. 1 and 2, as the color elements forming the pixel, four color elements or more may constitute one pixel. As shown in other embodiment of FIG. 4, for example, four color elements in which an yellowish green element 4YG is added to the red color element 4R, the green color element 4G, the blue color element 4B may constitute one pixel. In FIG. 4, in the in-line color element arrangement, the green color element 4G and the yellowish green color element 4YG having the high luminosity factor are disposed at the respective end positions, and the pixel in which the green color element 4G and the yellowish green color element 4YG are replaced with each other is alternately disposed at every row similarly as described above. Examining the green color element 4G having the highest luminosity factor, the green color elements 4G are arranged at an equal pitch L5 in the horizontal direction of one row and the pitch L5 in which the green color elements 4G are arranged in the horizontal direction of one row and the pitch L5 in which the green color elements 4G are arranged in the vertical direction are made equal to each other. Also in this case, the pixel pitch, the color element pitch and the pitches in which the green color elements 4G are arranged in the horizontal and vertical directions are made the same within the cell, between the cells, within the unit and between the units.

In the arrangement of FIG. 4, since the pixel seems to be located at the position of the green color element 4G having the highest luminosity factor, the position of this green color element 4G becomes the apparent pixel position.

Figure 5:
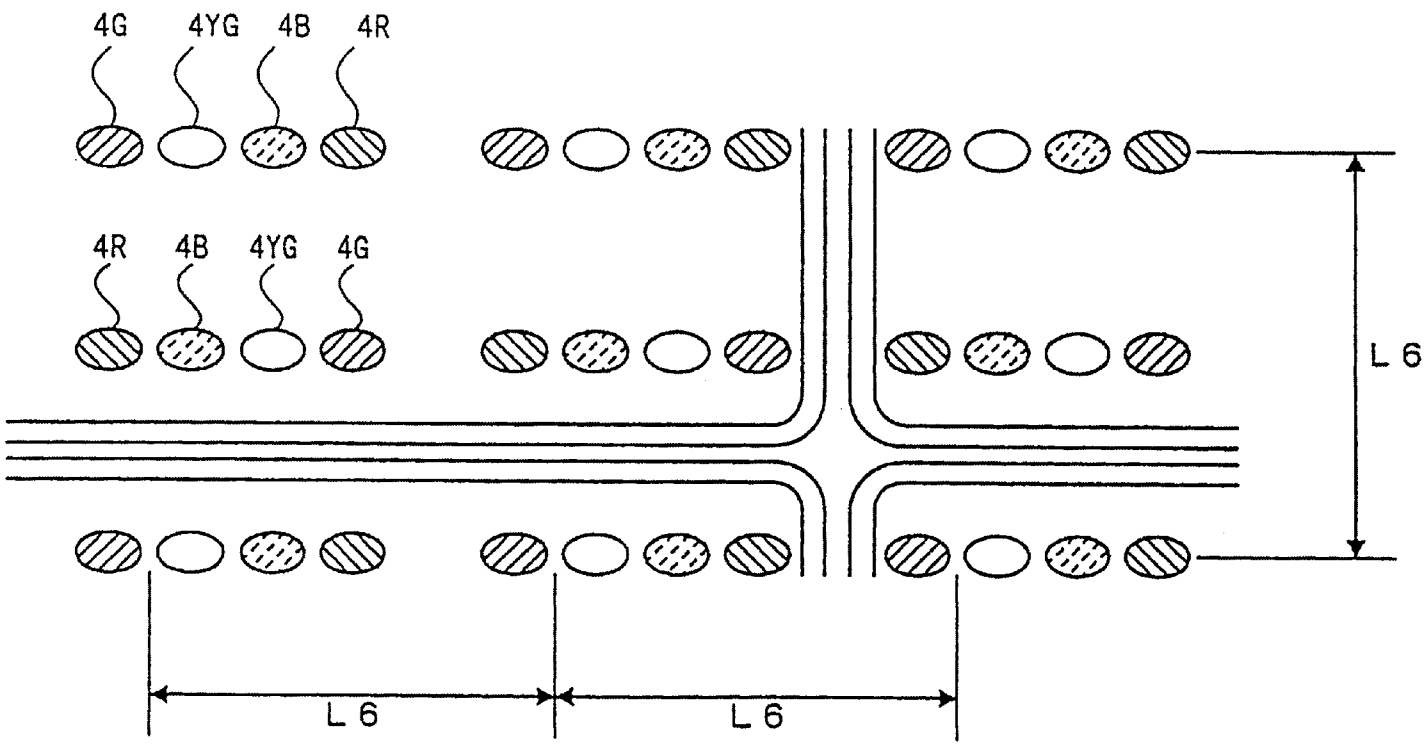
FIG. 5 is a structural diagram of a main portion of other embodiment showing a jumbo-size image display apparatus to which the present invention is applied.

Further, as shown in other embodiment of FIG. 5, while the same four color elements 4R, 4G, 4B and 4YG constitute one pixel as described above, the yellowish green color element 4YG may be disposed adjacent to the green color element 4G disposed at the outermost end. At that time, the pixel seems to be located at the position of the dichromatic element group (i.e. this dichromatic element group is the color element group having the highest luminosity factor) formed of the green color element 4G and the yellowish green color element 4YG both of which are high in luminosity factor. Accordingly, the position of the dichromatic element group (4G, 4YG) becomes the apparent pixel position. Also in this case, the color element group (4G, 4GY) having the highest luminosity factor is arranged at an equal pitch L6 in the horizontal direction of one row. Also, the pitch L6 in which the color element group (4G, 4YG) having the highest luminosity factor are arranged in the horizontal direction of one row and the pitch L6 in which the color element group (4G, 4YG) having the highest luminosity factor are arranged in the vertical direction are made equal to each other. Moreover, the pixel pitch, the color element pitch and the pitches in which the color element group (4G, 4YG) having the highest luminosity factor are arranged in the horizontal and vertical directions are made the same within the cell, between the cells, within the unit and between the units.

Also in the jumbo-size screen image display apparatus having the pixel arrangement of FIGS. 4 and 5, similarly to FIGS. 1 and 2, the apparent horizontal and vertical resolutions may be improved to avoid the disadvantage that the color is changed by the pixels hidden by the louvers.

While the LED is used as the color element in FIGS. 1, 2, 4 and 5, the present invention is not limited thereto, and there may be used a cathode-ray tube, a discharge tube, an organic electroluminescence element and a liquid-crystal element, for example.

Figure 7:
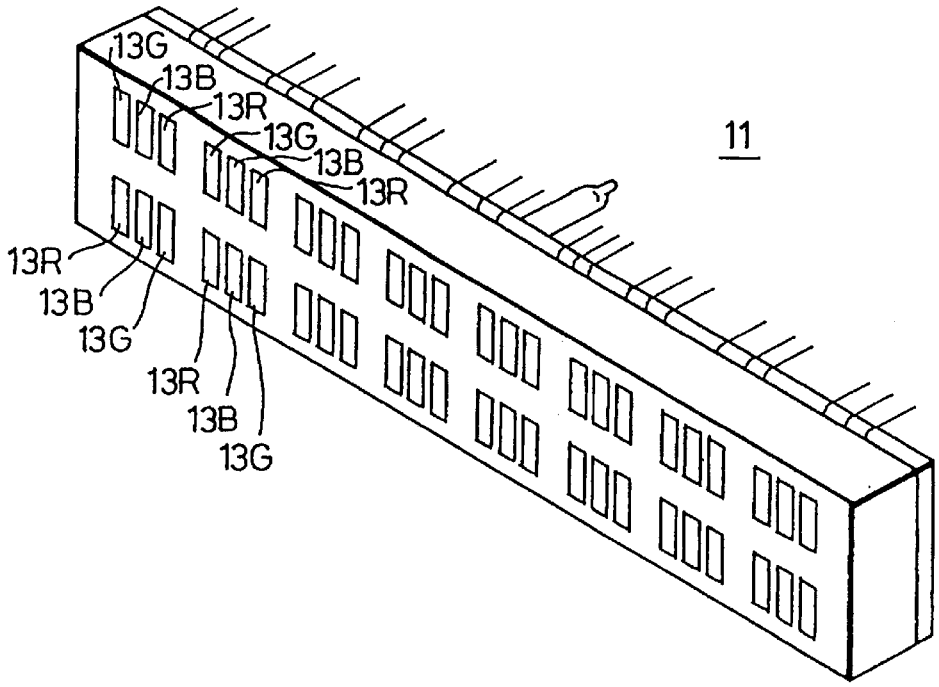
FIG. 7 is a perspective view showing an example of a cathode-ray tube which is applicable to a color element of an image display apparatus according to the present invention.
Figure 8:
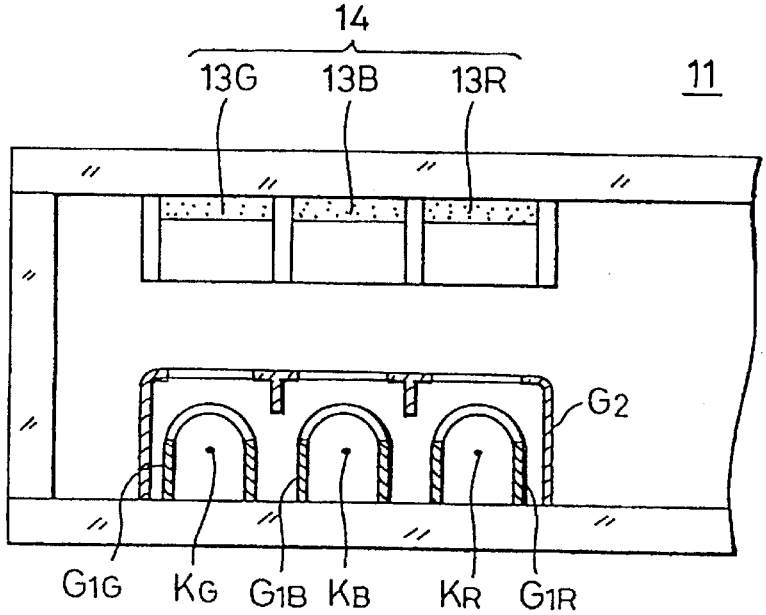
FIG. 8 is a cross-sectional view of a main portion of the cathode-ray tube of FIG. 7.

FIGS. 7 and 8 show an example of a cathode-ray tube that may be used as a color element. This cathode-ray tube 11 comprises an insulating container, e.g. glass container 12, a plurality of sets, in the illustrated example, totally 16 sets of 2 rows and 8 columns of fluorescent display units 14 composed of red (R), green (G) and blue (B) fluorescent layers 13 [13R, 13G, 13B] of oblong shape formed on the front plate of the glass container and an electrode unit composed of wire cathodes K [KR, KG, KB], first grids G1 [G1R, G1G, G1B] and second grids G2 [G2R, G2G, G2B]. There are formed separators 15 which are adapted to separate the fluorescent layers, e.g. the green, blue and red fluorescent layers 13G, 13B and 13R to which applied is an anode potential. In this cathode-ray tube 11, electron beams from the respective wire cathodes K [KR, KG, KB] are controlled by the first grid G1 and the second grid G2 and irradiated on the corresponding fluorescent layers 13R, 13G and 13B, thereby the fluorescent layers 13R, 13G and 13B being energized to become luminous.

As the cathode-ray tube including 16 elements, the fluorescent display unit 14 of each element corresponds to the above-mentioned color element. While there is shown the cathode-ray tube having the fluorescent display unit 14 comprising 16 elements in FIGS. 7 and 8, the present invention is not limited thereto, and there may be used a single-unit cathode-ray tube having a fluorescent display unit composed of one pixel or a cathode-ray tube including the proper number of elements.

The organic electroluminescence element may be formed by sandwiching an organic pigment thin film, for example, with a transparent electrode of an anode and a metal electrode of a cathode. In this organic electroluminescence element, when an electric field is applied to the organic pigment thin film from the respective electrodes, the organic pigment thin film is excited to become luminous.

As the discharge tube, there may be used a plasma discharge display tube in which a fluorescent layer is excited to become luminous by ultraviolet rays generated by plasma discharge occurred between a pair of electrodes, for example.

DESCRIPTION OF REFERENCE NUMERALS

1 . . . the color element
1R . . . the red color element
1G . . . the green color element
2B . . . the blue color element
2 . . . the louver
Pij . . . the small screen (cell)
Pi+1j . . . the small screen (cell)
4 . . . the color element
4R . . . the red color element
4G . . . the green color element
4B . . . the blue color element
4YG . . . the yellowish green color element
5 . . . the louver
11 . . . the cathode-ray tube
12 . . . the glass container
13 . . . the fluorescent layer
13R . . . the red fluorescent layer
13G . . . the green fluorescent layer
13B . . . the blue fluorescent layer
14 . . . the fluorescent display unit
15 . . . the separator
21 . . . the LED
22 . . . the one terminal
23 . . . the other terminal
24 . . . the horn portion
25 . . . the LED element
26 . . . the metal wire
27 . . . the mold resin

What is claimed is:

1. An image display apparatus having a pixel arrangement comprising: a plurality of pixels each formed of plural color elements arranged horizontally, said plurality of pixels being disposed in a plurality of horizontal lines and a plurality of vertical lines; the color element in each pixel having the highest luminosity factor being positioned at the right-hand end position of each pixel in one horizontal line and at the left-hand end position in an adjacent horizontal line.

2. The image display apparatus as claimed in claim 1 wherein said color element having the highest luminosity factor exhibits a pitch in the horizontal direction that is equal to the pitch thereof in the vertical direction.

3. The image display apparatus as claimed in claim 1 wherein adjacent color elements in a pixel exhibit a pitch approximately ¼ of the pitch of said pixels disposed in a horizontal line.

4. The image display apparatus as claimed in claim 1 wherein an array of pixels comprises a cell and plural cells form one unit; wherein said color element having the highest luminosity factor exhibits a pitch in the horizontal direction that is equal to the pitch thereof in the vertical direction, both within a cell and between respective cells.

5. The image display apparatus as claimed in claim 1 wherein an array of pixels comprises a cell, plural cells form one unit and a plurality of units form a display screen; and wherein said color element having the highest luminosity factor exhibits a pitch in the horizontal direction that is equal to the pitch thereof in the vertical direction, both within a unit and between respective units.

6. The image display apparatus as claimed in claim 1 wherein a horizontal line of pixels comprises a row; and further including a row of louvers disposed adjacent a respective row of pixels to interrupt an external light and thereby improve contrast of the image displayed thereby.

7. The image display apparatus as claimed in claim 1 wherein a horizontal line of pixels comprises a row; and further including a row of louvers disposed adjacent every n rows of pixels, where n is an integer, and thereby improve contrast of the image displayed thereby.

8. The image display apparatus as claimed in claim 1 wherein each color element is a light-emitting diode element.

9. The image display apparatus as claimed in claim 1 wherein each color element is a cathode-ray tube.

10. The image display apparatus as claimed in claim 1 wherein each color element is a discharge tube.

11. The image display apparatus as claimed in claim 1 wherein each color element is an organic electroluminescence element.

12. The image display apparatus as claimed in claim 1 wherein each color element is a liquid-crystal element.

13. An image display apparatus having a pixel arrangement comprising: a plurality of pixels each formed of a red color element, a green color elements and a blue color element arranged horizontally, said plurality of pixels being disposed in a plurality of horizontal lines and a plurality of vertical lines; the green color element in each pixel being positioned at the right-hand end position of each pixel in one horizontal line and at the left-hand end position in an adjacent horizontal line.

14. The image display apparatus as claimed in claim 13 wherein said green color element exhibits a pitch in the vertical direction that is equal to the pitch thereof in the horizontal direction.

15. The image display apparatus as claimed in claim 13 wherein an array of pixels comprises a cell and plural cells form one unit; and wherein said green color element exhibits a pitch in the vertical direction that is equal to the pitch thereof in the horizontal direction, both within a cell and between respective cells.

16. The image display apparatus as claimed in claim 13 wherein an array of pixels comprises a cell, plural cells form one unit and a plurality of units form a display screen; and wherein said green color element exhibits a pitch in the vertical direction that is equal to the pitch thereof in the horizontal direction, both within a unit and between respective units.

17. The image display apparatus as claimed in claim 13 wherein a horizontal line of pixels comprises a row; and further including a row of louvers disposed adjacent a respective row of pixels to interrupt external light and thereby improve contrast of the image displayed thereby.

18. The image display apparatus as claimed in claim 13 wherein a horizontal line of pixels comprises a row; and further including a row of louvers disposed adjacent every n rows of pixels, where n is an integer, and thereby improve contrast of the image displayed thereby.

19. The image display apparatus as claimed in claim 13 wherein each color element is a light-emitting diode element.

20. The image display apparatus as claimed in claim 13 wherein each color element is a cathode-ray tube.

21. The image display apparatus as claimed in claim 13 wherein each color element is a discharge tube.

22. The image display apparatus as claimed in claim 13 wherein each color element is an organic electroluminescence element.

23. The image display apparatus as claimed in claim 13 wherein each color element is a liquid-crystal element.

24. A method of arranging the pixels of an image display formed of an array of rows and columns of pixels each formed of a plurality of color elements arranged horizontally to form one pixel, said method comprising the steps of positioning the color element having the highest luminosity factor at the right-hand end position in each pixel in one row and positioning said color element having the highest luminosity factor at the left-hand end position in each pixel in an adjacent row.

25. The method of claim 24 wherein said color element having the highest luminosity factor exhibits a pitch horizontally that is equal to the pitch thereof vertically.

26. The method of claim 24 wherein adjacent color elements in a pixel exhibit a pitch approximately ¼ of the pitch of said pixels in a row.

27. A method of arranging the pixels of an image display formed of an array of rows and columns of pixels each formed of a red color element, a green color element and a blue color element arranged horizontally to form one pixel, said method comprising the steps of positioning the green color element at the right-hand end position in each pixel in one row and positioning said green color element at the left-hand end position in each pixel in an adjacent row.

28. The method of claim 27, wherein said green color element exhibits a pitch horizontally that is equal to the pitch thereof vertically.

* * * * *